United States Patent [19]

Hall

[11] Patent Number: 4,575,885

[45] **Date of Patent: * Mar. 18, 1986**

[54] WATERBED MATTRESS WITH FREE FLOATING BAFFLE

[75] Inventor: Charles P. Hall, Muir Beach, Calif.

[73] Assignee: Monterey Manufacturing Co., Carson, Calif.

[ * ] Notice: The portion of the term of this patent subsequent to Feb. 3, 1999 has been disclaimed.

[21] Appl. No.: 613,979

[22] Filed: May 25, 1984

Related U.S. Application Data

[63] Continuation of Ser. No. 250,888, Apr. 3, 1981, Pat. No. 4,467,485, and a continuation-in-part of Ser. No. 201,304, Oct. 27, 1980, abandoned, which is a continuation-in-part of Ser. No. 95,214, Nov. 19, 1979, Pat. No. 4,345,348, which is a continuation-in-part of Ser. No. 949,963, Oct. 10, 1978, Pat. No. 4,247,962.

[51] Int. Cl.[4] ..... A47C 27/08

[52] U.S. Cl. ..... 5/450; 5/451

[58] Field of Search ..... 5/450, 451, 452, 449, 5/422

[56] References Cited

U.S. PATENT DOCUMENTS

| | | | |
|---|---|---|---|
| 1,371,919 | 3/1921 | Mahony | 5/455 |
| 2,604,641 | 7/1952 | Reid | 5/455 |
| 3,600,726 | 8/1971 | Williams | 5/451 |
| 3,732,585 | 5/1973 | Krehbiel | 5/451 |
| 3,736,604 | 6/1973 | Carson | 5/451 |
| 3,748,669 | 7/1973 | Warner | 5/450 |
| 3,772,717 | 11/1973 | Yuen et al. | 5/450 |
| 4,145,780 | 3/1979 | Fogel | 5/451 |
| 4,152,796 | 5/1979 | Fogel | 5/451 |
| 4,168,555 | 9/1979 | Benjamin | 5/452 |
| 4,192,031 | 3/1980 | Fogel | 5/451 |
| 4,201,838 | 5/1980 | Goldberg | 428/316.6 |
| 4,204,289 | 5/1980 | Fogel | 5/451 |
| 4,245,361 | 11/1981 | Evanson | 5/451 |
| 4,301,560 | 11/1981 | Fraige | 5/450 |
| 4,325,152 | 4/1982 | Carpenter | 5/451 |
| 4,332,043 | 6/1982 | Larson | 4/451 |
| 4,345,348 | 8/1982 | Hall | 5/451 |
| 4,411,033 | 10/1983 | Morgan | 5/450 |
| 4,462,128 | 7/1984 | LaBianco | 5/450 |

FOREIGN PATENT DOCUMENTS

| | | | |
|---|---|---|---|
| 387528 | 9/1976 | Sweden | 5/450 |
| 608951 | 2/1979 | Switzerland | 5/450 |

*Primary Examiner*—Alexander Grosz

*Attorney, Agent, or Firm*—Sheldon & Mak

[57] ABSTRACT

A waterbed mattress has an internal horizontally-extending baffle for reducing wave-like motion of the water in the mattress. The baffle comprises at least two horizontally-extending layers secured together, a first layer denser than water and a second layer less dense than water. The first layer can be a porous mass of bound-together fibers and the second layer can be closed cell polymeric foam. The baffle, which floats spaced apart from the bottom wall of the mattress, is foldable and collapsible, so that the entire mattress can be folded for storage.

28 Claims, 6 Drawing Figures

WATERBED MATTRESS WITH FREE FLOATING BAFFLE

CROSS-REFERENCES

This application is a continuation of Application Ser. No. 250,888, filed on Apr. 3, 1981, now U.S. Pat. No. 4,467,485, which is a continuation-in-part of Application Ser. No. 201,304, filed on Oct. 27, 1980, now abandoned, which is continuation-in-part of Application Ser. No. 95,214, filed on Nov. 19, 1979, now U.S. Pat. No. 4,345,348, which is a continuation-in-part of Application Ser. No. 949,963, filed on Oct. 10, 1978, U.S. Pat. No. 4,247,962. This application is related to Application Ser. No. 134,628, now U.S. Pat. No. 4,382,305, and Ser. No. 134,629 filed on Mar. 27, 1980 now abandoned. Each of these applications and patents is incorporated herein by this reference.

BACKGROUND

This invention pertains generally to waterbeds, and more particularly to a waterbed mattress having baffle means for preventing excessive undulations of water in the mattress.

Although waterbeds have enjoyed wide popularity in recent years, some persons are disturbed by the wave-like motion or undulations of the water within the mattress. There have been many attempts to reduce the water movement, for example, by employing vertically-extending baffles inside the mattress. Carson in U.S. Pat. No. 3,736,604 describes a waterbed mattress having perforated, freely-swingable vertical flaps to resist excessive motion of fluid within the mattress. In addition, Fogel in U.S. Pat. No. 4,145,780 describes a waterbed mattress having a baffle dampener comprising an upstanding plastic sheet and a horizontal flotation rod.

Improvements in dampening wave motion have been obtained by using horizontally-extending baffles. Such baffles are described in my aforementioned U.S. Pat. No. 4,247,962 and my U.S. Pat. No. 4,345,348. These horizontally-extending baffles can comprise a pad of buoyant material anchored to the bottom wall of the mattress so that the pad floats between the top and bottom walls. Fogel in U.S. Pat. No. 4,192,031 describes a baffle comprising a horizontally-extending piece of foam anchored to the bottom of the mattress. Although horizontally extending baffles can be effective in reducing water wave motion, baffles secured to a wall of the mattress when the mattress comprises an inner enclosure and an outer liner cannot be used because it is difficult to assemble such a mattress. Further, a weld to the inner bag can form a leak path.

My U.S. Pat. No. 3,585,356 shows a waterbed mattress having a plurality of solid particles of a material such as Styrofoam TM floating in the water for dampening shock waves in the water. Although the particles of Styrofoam TM can reduce wave motion, if the Styrofoam TM is provided as a solid block more effective wave reduction results. However, it is difficult to fold a solid block of Styrofoam TM in a mattress for storage or shipping.

Therefore, it is apparent that there is a need for a baffled waterbed mattress that (i) can be folded, (ii) has the advantages of a horizontally-extending baffle, (iii) does not require the baffle to be secured to any of the walls of the mattress, and (iv) has a baffle that floats spaced apart from the bottom wall of the mattress.

SUMMARY

The present invention is directed to a novel waterbed mattress satisfying these requirements. The mattress has a novel baffle structure that prevents excessive undulations of water in the mattress. The mattress comprises an enclosing structure having a horizontally-extending top surface and a horizontally-extending bottom surface. Wthin the enclosing structure there is a horizontally-extending baffle structure that is unattached to the enclosing structure so that the baffle structural can float freely. The baffle structure preferably comprises at least two horizontally-extending layers secured together, a first layer denser than water and a second layer less dense than water. The second layer has sufficient mass that the baffle floats spaced apart from the bottom surface of the mattress when the mattress is filled with water.

The materials for the baffle are chosen so that the entire waterbed mattress, including the baffle, can be folded for storage. For example, the first layer can comprise a porous mass of bound-together fibers and the second layer can comprise closed cell polymeric foam.

Preferably, the layer of foam has a horizontal extent corresponding generally to the horizontal extent of the sleeping surface of the mattress and is secured to the bottom side of the fibrous layer. With this configuration, water circulates between the volume below and the volume above the mattress due to the porosity of the fibrous layer, and the foam layer is spaced apart from both the bottom wall and the top wall of the mattress for maximum dampening of water wave motion.

In a less preferred version, the baffle structure comprises only a porous mass of bound-together fibers. A disadvantage with this structure is that the fibers are in contact with the bottom wall due to the density of the fibrous layer. This results in less dampening of wave motion than if the fibrous layer were adjacent the top wall of the mattress. Further, hot spots can develop in the bottom wall of the mattress where the fibrous layer contacts the position of the wall adjacent the heater. Such hot spots can shorten the useful life of the mattress and can lead to water leaks.

For maximum dampening of wave action in the mattress, preferably the baffle structure comprises at least three layers, an inner layer of closed cell polymeric foam sandwiched between two outer layers, each comprising a porous mass of bound-together fibers.

In use, the combination of a horizontally-extending surface and the porous mass of fibers quickly and effectively dampens wave action. With a three-layer construction, any waves reflected from either the top surface or the bottom surface of the mattress are quickly dampened. Because the baffle structure preferably is spaced apart from the bottom surface, there is a water layer along the bottom surface, including where the heater is located, thereby avoiding the formation of hot spots. Moreover, the baffle structure, being spaced apart from the bottom layer, is more effective in dampening wave action from waves reflected off the bottom surface than is a baffle in contact with the bottom surface.

DRAWINGS

These and other features, aspects, and advantages of the present invention will become better understood with the reference to the following description, appended claims, and accompanying drawings where:

DESCRIPTION

Figure 1:
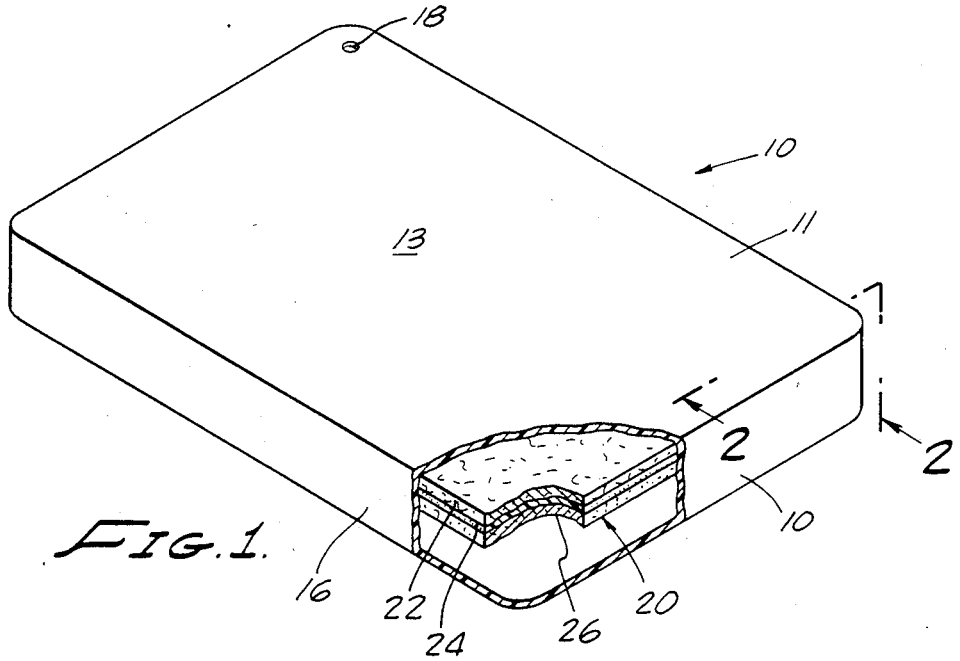
FIG. 1 is a perspective view, partly broken away, of a waterbed mattress according to the present invention, having a free-floating baffle.

The present invention is directed to a foldable waterbed mattress 10 that has significantly less wave-like motion at the surface of the mattress than conventional waterbed mattresses. This novel waterbed mattress has an enclosing structure 11 containing a body of water 12. The enclosing structure is fabricated of a flexible material and includes a top wall or surface 13, a bottom wall or surface 14, and vertical side walls 16. The top surface is adapted for receiving persons in sitting and reclining positions and is referred to as the sleeping surface of the mattress. The enclosing structure can be formed in any suitable manner, for example, by bonding two planar sheets together along their peripheries or by bonding upstanding sheets between the edges of the top and bottom walls to form a contoured or fitted structure. Water is introduced into and removed from the mattress through a valve 18 located toward a corner of the top wall.

The enclosing structure can be made of a flexible material such as polyvinylchloride or polyethylene. As described in Application Ser. Nos. 134,629 now abandoned and Application Ser. No. 134,628, now U.S. Pat. No. 4,382,305, both applications being filed on Mar. 27, 1980, the mattress can comprise an internal enclosing structure made of a material that is unaffected by long-term direct contact with water, such as polyethylene. The internal enclosing structure can be provided with an exterior envelope of a material such as polyvinylchloride. Between the envelope and the internal enclosing structure can be an internal layer of viscous, water-resistant sealing material for sealing leaks in the envelope. A valve suitable for such a waterbed mattress is described in my copending Application Ser. No. 134,627 filed Mar. 27, 1980, now abandoned which is incorporated herein by this reference.

Figure 2:
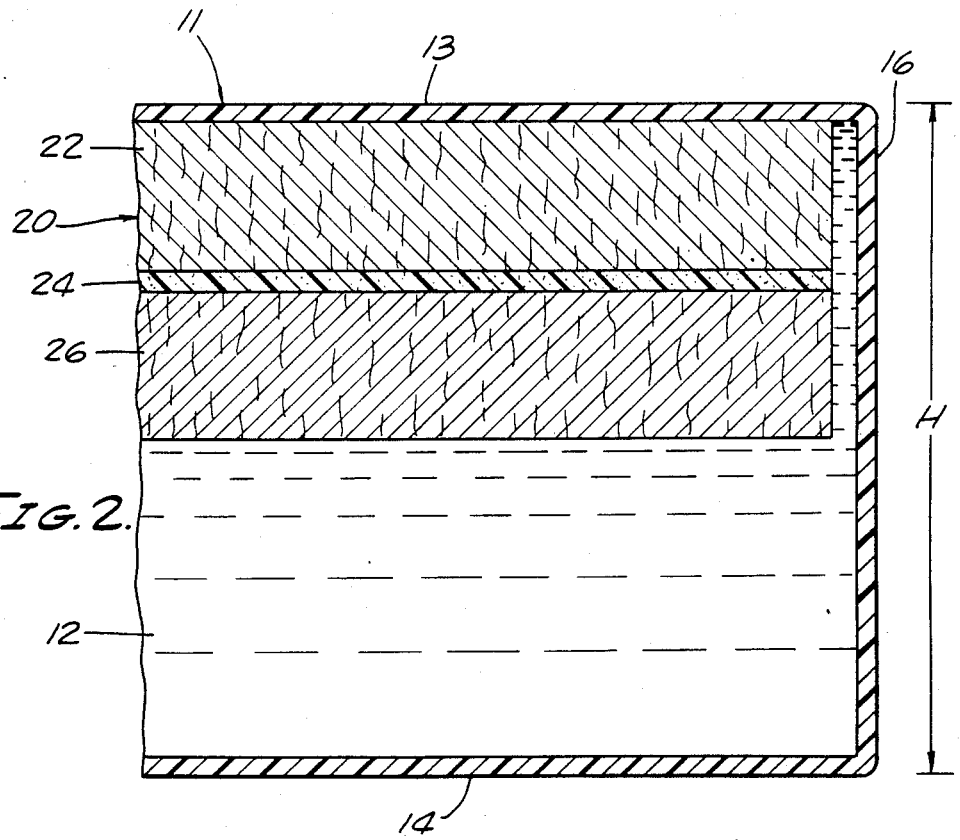
FIG. 2 is a fragmentary sectional view of the mattress of FIG. 1 taken along line 2—2 in FIG. 1.
Figure 3:
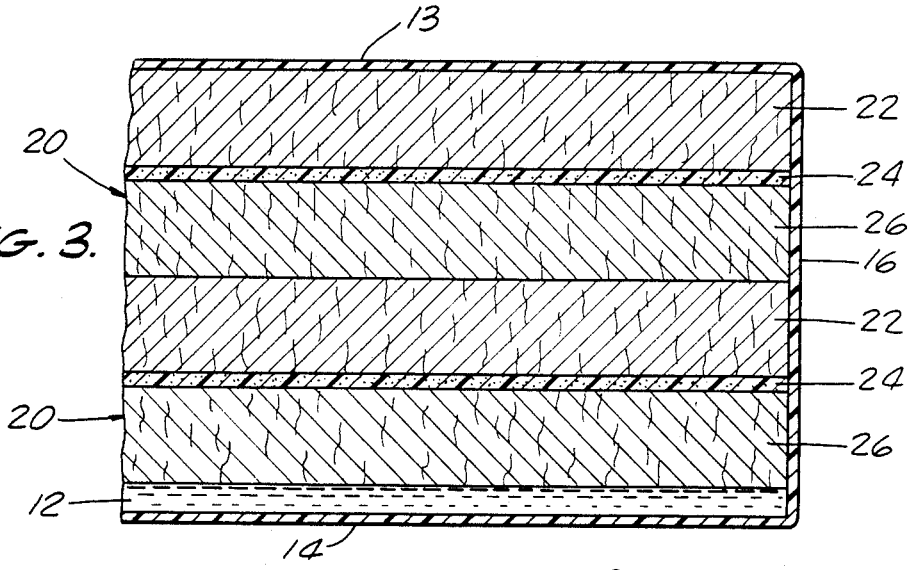
FIGS. 3–5 are fragmentary sectional views of other waterbed mattresses according to the present invention taken along a line corresponding to line 2—2 in FIG. 1.

With reference to FIGS. 1 and 2, the waterbed mattress is provided with a horizontally-extending baffle surface or structure 20 within the enclosing structure. The baffle is unattached to the enclosing structure, i.e. it can float freely in the mattress when the mattress is filled with water, and is not anchored to the side, bottom, or top walls. The baffle structure 20 preferably comprises at least two, and as shown in FIGS. 1, 2, and 3, preferably three horizontally-extending layers secured together. With reference to FIGS. 1, and 2, there is a top layer 22 of a material denser than water, a middle layer 24 of a material less dense than water, and a bottom layer 26 of a material denser than water. There need not be three layers, but preferably there is at least one layer denser than water and one layer less dense than water. The middle layer 24 is sandwiched between the top layer 22 and the bottom layer 26. Preferably the layers are all of the same surface area with their edges coinciding. The mass of the middle layer is sufficiently large that when the mattress 10 is filled with water, the baffle 20 floats in the enclosing structure 11 spaced apart from the bottom surface 14, each layer having a horizontal extent corresponding to the horizontal extent of the sleeping surface of the mattress.

A preferred material for the top layer 22 and the bottom layer 26 is a porous, foldable, compressible mass of bound together fibers. Exemplary of such a material is 45 denier nonwoven polyester fibers bound together with acrylic resin that is available from E. R. Carpenter of La Mirada, Calif. The material is foldable so that the mattress can be stored easily. Because of the porosity and the individual strands of fiber, the material is extremely effective in dampening waterwave action. The material is sufficiently porous that it is possible to pour water right through it.

A particular advantage of the material available from E. R. Carpenter is that it is produced by an air-lay process, where the fibers are both vertically and horizontally oriented before they are bound together with resin. Because the fibers are both vertically and horizontally oriented, the layer 24 is stronger and has more loft per pound of fiber than if the fibers were only horizontally oriented. Because of the extra loft, it is possible to obtain more dampening per pound of fiber compared to a layer made of only horizontally randomly oriented fibers.

The middle layer 24 is preferably formed from a closed-cell polymeric foam such as polyurethane foam, Styrofoam TM, or polyethylene foam. The three layers can be secured together by sewing the layers together along the length of the baffle. The top layer 22 and the bottom layer 26 each can be sewed to the middle layer 24.

For effective reduction of the wave motion, preferably the baffle structure 20 has a horizontal extent corresponding generally to the horizontal extent of the top surface 13 of the mattress. In a king-sized mattress having a sleeping area measuring 84×72 inches, the baffle can have a length of 76 inches and a width of 64 inches. It is important that the baffle structure has a large horizontal extent to obtain adequate dampening of the wave-like motion of the water in the waterbed. To obtain adequate dampening, preferably the baffle structure, including the middle layer 24, has a horizontal extent such that its top surface area is equal to at least about two-thirds of the surface area of the sleeping surface, and more preferably is equal to at least about three-quarters of the surface area of the sleeping surface.

If desired, more than one baffle structure 20 side-by-side can be used, as long as the total top surface area of the baffles is equal to at least about two-thirds of the surface area of the sleeping surface. Preferably only one baffle structure is used for ease of fabrication and folding. Further, with more than one baffle, it is possible that one of the baffles can move into position below the other baffle.

By proper selection of the thicknesses of the layers and the density of the material used for the three layers, the free floating position of the baffle structure 20 can be controlled. It is important that the baffle be maintained away from the bottom surface of the mattress. Preferably the baffle structure is spaced apart from the top surface of the mattress for effective reduction in wave action. However, when a person is laying on a mattress, the baffle can come into contact with the top surface 13 of the mattress. In operation and use, the enclosure 11 is filled with water, and the baffle structure 20 floats in the enclosure spaced apart from the bottom wall 14.

For adequate dampening of wave action, preferably the thickness of the baffle structure is at least about 30 percent the height of the enclosure (H in FIG. 2) when the mattress is filled with water. For example, for a waterbed having a height of about nine inches, the top layer 22 and the bottom layer 26 can each be two inches thick, with the middle layer 22 one-quarter inch thick. Thus, the baffle structure 20 comprises about 47 percent of the height of the mattress. The thicker the baffle, and particularly the thicker the top 22 and the bottom 26 layers, the more effective is the baffle in dampening wave action. However, as the thickness of the baffle structure increases, the cost of the baffle correspondingly increases.

As shown in FIG. 3, increased thickness can be achieved by placing two baffle structures 20 in a mattress one on top of another. In this version there are two foam layers 24 and four fibrous layers, giving total thickness of $8\frac{1}{2}$ inches. This corresponds to over 90% H.

The baffle structure 20 and the waterbed mattress 10 having the baffle provide substantial advantages compared to prior art structures. For example, no anchors are required to hold the baffle in position. This eliminates the cost of manufacturing anchors, attaching anchors to the baffle, and securing anchors to the enclosing structure. Further, the welds required for anchors can be the source of water leaks. In addition, the stresses caused on the waterbed mattress resulting from anchoring can cause water leaks.

A further advantage of the baffle structure 20 is that it can be used with mattresses which are incapable of having baffles requiring anchoring. For example, a mattress comprising an inner enclosure with an outer liner is not adaptable for anchored baffles.

In addition, because the baffle structure 20 floats away from the bottom surface 14 of the mattress, hot spots in the vicinity of the heater do not develop. This helps insure that the waterbed mattress will have a long life.

Figure 4:
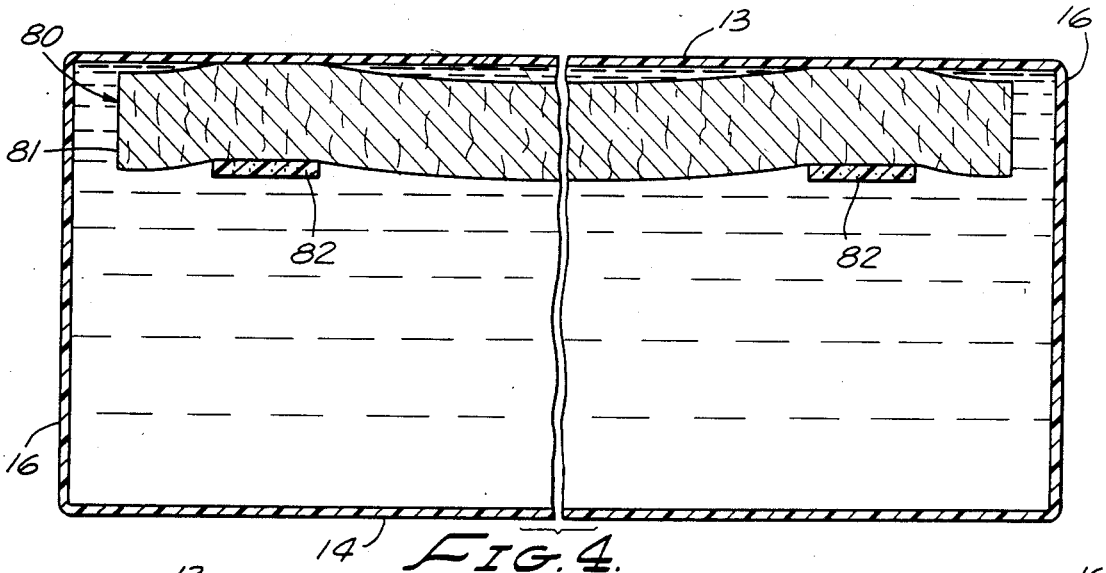
Figure 5:
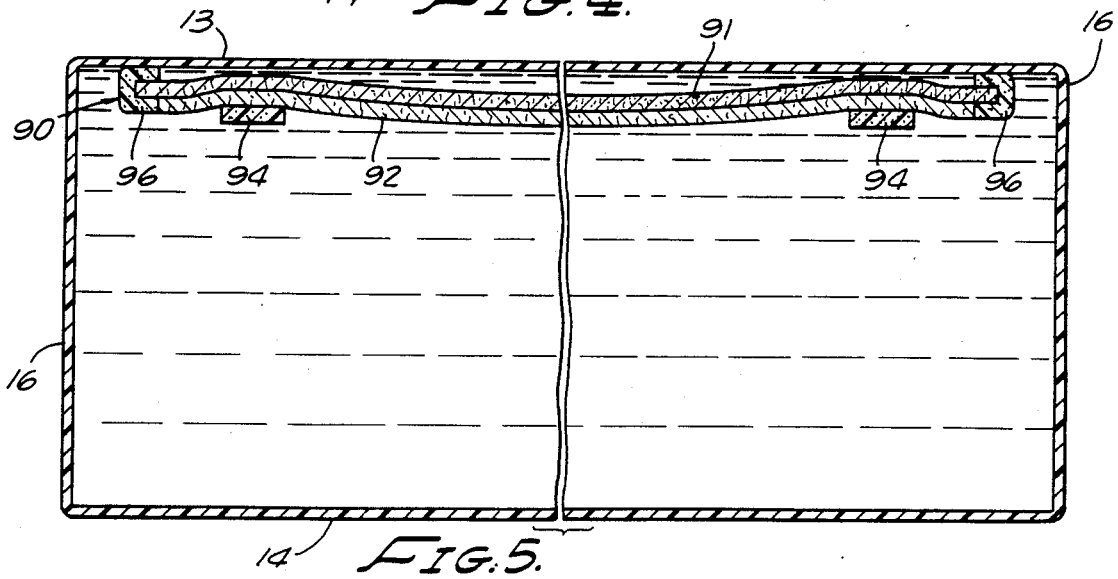

In the versions of the invention show in FIGS. 4 and 5, the foam layer does not comprise a single layer that is coextensive with the fibrous layer. With reference to FIG. 4, the baffle structure 80 comprises a horizontally extending fibrous layer 81 and two narrow strips 82 of foam secured to the bottom surface of the fibrous layer. The strips 82 of foam extend along substantially the entire length of the fibrous layer 81. It has been found that the strips of foam provide sufficient buoyancy to maintain the fibrous layer 81 spaced apart from the bottom wall of the mattress of FIG. 4.

With reference to FIG. 5, the baffle structure 90 comprises two layers 91 and 92 of fibrous material bound together, one on top of the other. The lower layer 92 is of slightly smaller lateral extent than the top layer 91. The fibrous material is maintained spaced apart from the bottom wall of the mattress by two strips 94 of foam attached to the underside of the bottom layer 92. The strips 94 of foam extend substantially the entire length of the baffle structure 90. In addition, there are two edge strips 96 of foam secured to the fibrous layers 91 and 92 along their longitudinal edges. The edge strips 96 extend substantially the entire length of the baffle structure 90. The edge strips overlay the top surface of the upper fibrous layer 91 and underlay the bottom surface of the upper fibrous layer 91, and abut against the longitudinal edge of the lower fibrous layer 92.

The versions of the present invention shown in FIGS. 1 and 2 are preferred because maximum dampening of water wave action is obtained. This is at least partly due to the fact that there is a foam layer or pad that is spaced apart from both the top and bottom walls of the mattress and which has a horizontal extent corresponding generally to the horizontal extent of the sleeping surface of the mattress. Water motion caused by sitting on the top surface of the mattress 13, and any waves that are reflected off the top and bottom surfaces that pass through the fibrous layers 22, are quickly dampened by the foam pad 24. Because of the porosity of the fibrous material, there is communication between the water volume below and the water volume above the foam pads 24. The version of FIG. 3 is most preferred because there are two horizontally extending foam pads spaced apart from both the top and bottom walls of the mattress. This gives even better wave motion dampening than the version of the invention shown in FIGS. 1 and 2.

The firmness of the mattress is party dependent upon the vertical position of the foam pad within the enclosing structure, with the firmness increasing as the pad is position closer to top wall. When the foam pad 24 of FIG. 2 is too close to either the top or bottom wall, the damping effect of the foam pad can be reduced. Furthermore, if the baffle surface is too close to the top wall, the mattress can be too firm for comfortable sleeping. Preferably the foam pad is positioned at a vertical distance of from $\frac{1}{2}$ H to 15/16 H above the bottom wall of the enclosure, where H is the distance between the bottom wall and the top wall when the mattress is filled with water as shown in FIG. 2. More preferably, the foam pad 24 is positioned a vertical distance above the bottom wall of from $\frac{2}{3}$ H to $\frac{3}{4}$ H. Thus, the foam pad 24 is closer to the top wall than the bottom wall when the mattress is filled with water. With a mattress having a depth of nine inches and a $\frac{1}{4}$ inch foam pad, a good balance between firmness and wave suppression is provided by having the upper fibrous layer 22 about two inches thick so that the foam pad is about six to seven inches above the bottom wall of the enclosure.

Figure 6:
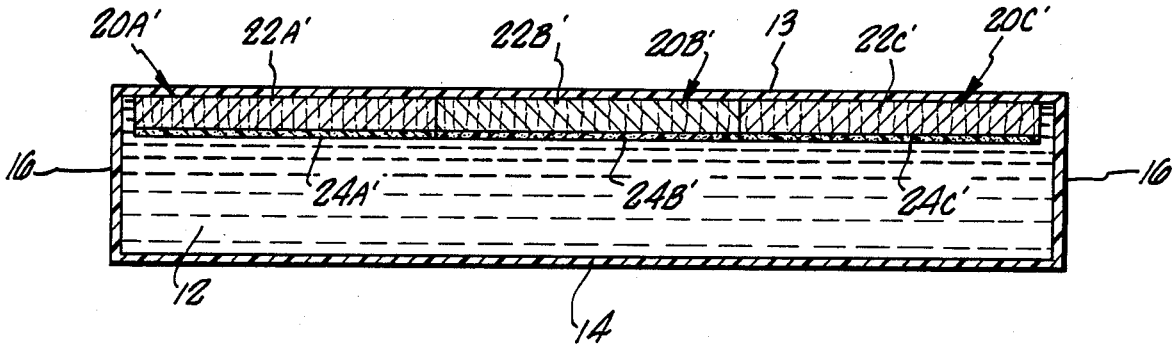
FIG. 6 is sectional view of another version of a waterbed mattress according to the present invention.

More than one baffle structure side-by-side can be used. With reference to FIG. 6, a watebed mattress having a top wall 13', bottom wall 14', and side wall 16' has three baffle sructures 20A', 20B' and 20C' side-by-side. Each baffle structure comprises a top layer 22A', 22B' or 24C' of fibrous material denser than water and a lower layer 24A', 24B' or 24C' of a material less dense than water such as closed-cell polymeric foam such as polyurethane foam.

Although the present invention has been described in considerable detail with regard to certain versions thereof, other versions are possible. For example, the baffle structures described herein need not be provided or sold as an integral part of an existing mattress. In addition, the fiber layer can be made of material less dense than water to insure that the baffle structure is spaced apart from the bottom wall of the mattress. However, at present, such a material has less wave dampening capability than the fiber from E. R. Carpenter described herein. Therefore, the spirit and scope of the appended claims should not necessarily be limited to the description of the preferred versions contained herein.

What is claimed is:

1. In a waterbed mattress having an enclosing structure comprising a horizontally extending top wall, a horizontally extending bottom wall, and side walls, the improvement comprising a horizontally extending baffle structure for reducing wave-like motion of water in the mattress disposed within the enclosing structure comprising at least one baffle element, the baffle element having a horizontal extent corresponding generally to the sleeping surface of the mattress, and being unattached to the enclosing structure and comprising a porous mass of bound-together fibers denser than water and means for floating the mass of fibers vertically spaced apart from the bottom wall when the mattress is filled with water, the baffle permitting water to circulate between the top wall and the bottom wall.

2. The mattress of claim 1 wherein the baffle structure comprises more than one baffle element disposed side by side.

3. The mattress of claim 1 wherein the baffle structure upper surface area is at least about two-thirds of the surface area of the top surface.

4. The mattress of claim 1 wherein the baffle structure upper surface area is at least about three quarters of the surface area of the top surface.

5. In a waterbed mattress having an enclosing structure comprising a horizontally extending top wall, a horizontally extending bottom wall, and side walls, the improvement comprising at least one horizontally extending pad disposed within the enclosing structure and spaced apart from the top and the bottom walls for limiting the motion of water in the mattress, the pad having a horizontal extent corresponding generally to the sleeping surface of the mattress, the pad permitting water to circulate between the volume below and the volume above the mattress, and including a horizontally extending porous mass of bound together fibers denser than water between the pad and the top wall.

6. The mattress of claim 5 in which the porous mass of bound-together fibers is in contact with the top wall.

7. The mattress of claim 5 in which the pad comprises closed cell polymeric foam less dense than water.

8. The mattress of claim 5 having more than one pad disposed side by side.

9. The mattress of claim 5 wherein the pad upper surface area is at least about two-thirds of the surface area of the top surface.

10. The mattress of claim 5 wherein the pad upper surface area is at least about three quarters of the surface area of the top surface.

11. The mattress of claim 5 wherein the pad is unattached to the enclosing structure.

12. A foldable waterbed mattress comprising:

(a) an enclosing structure comprising a horizontally-extending top surface and a horizontally-extending bottom surface; and (b) a horizontally-extending baffle structure having a horizontal extent corresponding to the horizontal extent of the top surface of the mattress and unattached to the enclosing structure, the baffle structure comprising at least one baffle element comprising a first horizontally extending layer denser than water comprising a porous mass of bound together fibers, and a second layer less dense than water, the second layer having sufficient mass that the baffle structure floats spaced apart from the bottom surface when the mattress is filled with water, and wherein the entire waterbed mattress, including the baffle structure can be folded for storage, the baffle structure permiting water to circulate between the top surface and the bottom surface.

13. The mattress of claim 12 wherein the second layer is horizontally extending and substantially co-extensive with the first layer.

14. The mattress of claim 12 in which the thickness of the baffle structure is at least about 30% of the height of the mattress when the mattress is filled with water.

15. The mattress of claim 12 in which the top layer is in contact with the top surface when the mattress is filled with water.

16. A foldable waterbed mattress comprising:

(a) an enclosing structure comprising a horizontally extending top surface and a horizontally extending bottom surface; and (b) a horizontally extending baffle structure unattached to the enclosing structure and within the enclosing structure, comprising an inner layer less dense than water between two outer layers of a porous mass of bound together fibers, the outer layers being denser than water, the inner layer having sufficient mass whereby the baffle structure floats spaced apart from the bottom surface when the mattress is filled with water, wherein the entire mattress, including the baffle structure, can be folded for storage.

17. The mattress of claim 16 wherein the baffle structure upper surface area is at least about two-thirds of the surface area of the top surface.

18. The mattress of claim 16 wherein the inner layer comprises closed cell polymeric foam.

19. The mattress of claim 16 wherein the inner and outer layers are substantially coextensive with each other.

20. The mattress of claim 16 wherein the mattress comprises two such baffle structures, one on top of the other.

21. The mattress of claim 16 wherein the baffle structure has a horizontal extent corresponding generally to the sleeping surface of the mattress.

22. In a waterbed mattress having an enclosing structure comprising a horizontally extending top wall, a horizontally extending bottom wall, and side walls, the improvement comprising a horizontally extending baffle structure for reducing wave-like motion of water in the mattress disposed within the enclosing structure comprising at least one baffle element, the baffle structure having a horizontal extent corresponding generally to the sleeping surface of the mattress, and being unattached to the enclosing structure and comprising a porous mass of bound-together fibers denser than water and means comprising closed cell polymeric foam for floating the mass of fiber vertically spaced apart from the bottom wall when the mattress is filled with water, the baffle permitting water to circulate between the top wall and the bottom wall.

23. The mattress of claim 22 wherein the floating means comprises at least two strips of buoyant foam.

24. The mattress of claim 22 wherein the floating means comprises a layer of closed cell polymeric foam.

25. The mattress of claim 22 wherein the baffle structure comprises more than one baffle element disposed side by side.

26. The mattress of claim 22 wherein the baffle structure upper surface area is at least about two-thirds of the surface area of the top surface.

27. The mattress of claim 22 wherein the baffle structure upper surface area is at least about three quarters of the surface area of the top surface.

28. A foldable waterbed mattress comprising (a) an enclosing structure comprising a horizontally-extending top surface and a horizontally-extending bottom surface, and (b) a horizontally-extending baffle structure comprising at least one baffle element having a horizontal extent corresponding to the horizontal extent of the top surface of the mattress and unattached to the enclosing structure, the baffle element comprising, a horizontally extending layer denser than water and a horizontally extending homogeneous sheet less dense than water, the sheet being substantially coextensive with the dense layer and having sufficient mass whereby the baffle structure floats spaced apart from the bottom surface when the mattress is filled with water, and wherein the entire waterbed mattress, including the baffle structure, can be folded for storage, the baffle structure permitting water to circulate between the top surface and the bottom surface.

* * * * *